US008398431B1

(12) United States Patent
Whiteman, Jr. et al.

(10) Patent No.: US 8,398,431 B1
(45) Date of Patent: Mar. 19, 2013

(54) RECEPTACLE ASSEMBLY

(75) Inventors: Robert Neil Whiteman, Jr., Middletown, PA (US); Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/279,806

(22) Filed: Oct. 24, 2011

(51) Int. Cl.
*H01R 13/648* (2006.01)

(52) U.S. Cl. ..... 439/607.06

(58) Field of Classification Search . 439/607.04–607.15
See application file for complete search history.

(56) References Cited

U.S. PATENT DOCUMENTS

| | | | | |
|---|---|---|---|---|
| 7,530,846 | B1 * | 5/2009 | Chen | 439/607.05 |
| 7,775,802 | B2 * | 8/2010 | Defibaugh et al. | 439/65 |
| 7,927,143 | B2 * | 4/2011 | Helster et al. | 439/607.05 |
| 7,976,318 | B2 * | 7/2011 | Fedder et al. | 439/79 |
| 7,976,340 | B1 * | 7/2011 | Saraswat et al. | 439/607.07 |
| 8,157,591 | B2 * | 4/2012 | Fedder et al. | 439/607.07 |
| 8,157,595 | B2 * | 4/2012 | Saraswat et al. | 439/620.09 |
| 2010/0144201 | A1 * | 6/2010 | Defibaugh et al. | 439/607.05 |
| 2010/0144204 | A1 * | 6/2010 | Knaub et al. | 439/607.07 |
| 2012/0129394 | A1 * | 5/2012 | Davis et al. | 439/607.01 |
| 2012/0129395 | A1 * | 5/2012 | Davis et al. | 439/607.01 |
| 2012/0184140 | A1 * | 7/2012 | Davis et al. | 439/607.34 |

* cited by examiner

*Primary Examiner* — Ross Gushi

(57) ABSTRACT

A receptacle assembly includes a front housing configured for mating with a header assembly and a contact module coupled to the front housing. The contact module includes a conductive holder having a first side wall and an opposite second side wall and a front coupled to the front housing. The conductive holder holds a frame assembly having a plurality of contacts and a dielectric frame supporting the contacts. The dielectric frame is received in the conductive holder and the contacts extend from the conductive holder for electrical termination. A ground shield is coupled to the first side wall. The ground shield is electrically connected to the conductive holder. The ground shield has grounding beams extending therefrom that extend forward of the front of the conductive holder for electrical connection to an interior surface of a corresponding header shield of the header assembly. The ground shield has grounding fingers extending therefrom forward of the front of the conductive holder for electrical connection to an interior surface of the corresponding header shield of the header assembly.

20 Claims, 4 Drawing Sheets

RECEPTACLE ASSEMBLY

BACKGROUND OF THE INVENTION

The subject matter herein relates generally to connector assemblies.

Some electrical systems utilize electrical connectors to interconnect two circuit boards, such as a motherboard and daughtercard. Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other.

Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground contacts on both electrical connectors that are connected together to electrically connect the ground circuits of the electrical connectors. Typically, the connection between the ground contacts is located at a single point of contact.

A need remains for an electrical system having improved shielding to meet particular performance demands.

BRIEF DESCRIPTION OF THE INVENTION

In one embodiment, a receptacle assembly is provided having a front housing configured for mating with a header assembly and a contact module coupled to the front housing. The contact module includes a conductive holder having a first side wall and an opposite second side wall and a front coupled to the front housing. The conductive holder holds a frame assembly having a plurality of contacts and a dielectric frame supporting the contacts. The dielectric frame is received in the conductive holder and the contacts extend from the conductive holder for electrical termination. A ground shield is coupled to the first side wall. The ground shield is electrically connected to the conductive holder. The ground shield has grounding beams extending therefrom that extend forward of the front of the conductive holder for electrical connection to an interior surface of a corresponding header shield of the header assembly. The ground shield has grounding fingers extending therefrom forward of the front of the conductive holder for electrical connection to an interior surface of the corresponding header shield of the header assembly.

In another embodiment, a receptacle assembly is provided having a front housing that is configured for mating with a header assembly. The front housing has contact openings therethrough. A contact module is coupled to the front housing. The contact module includes a conductive holder that has a first side wall and an opposite second side wall. The conductive holder has a front coupled to the front housing. The conductive holder holds a frame assembly. The frame assembly includes a plurality of contacts and a dielectric frame supporting the contacts. The dielectric frame is received in the conductive holder. The contacts extend from the conductive holder into corresponding contact openings for electrical termination to header contacts of the header assembly. The receptacle assembly includes a first ground shield coupled to the first side wall that is electrically connected to the conductive holder. The first ground shield has grounding beams extending therefrom extending forward of the front of the conductive holder for electrical connection to an interior surface of a corresponding header shield of the header assembly. The first ground shield has grounding fingers extending therefrom extending forward of the front of the conductive holder for electrical connection to an interior surface of the corresponding header shield of the header assembly. The receptacle assembly includes a second ground shield coupled to the second side wall that is electrically connected to the conductive holder. The second ground shield has grounding beams extending therefrom extending forward of the front of the conductive holder for electrical connection to an interior surface of a corresponding header shield of the header assembly. The second ground shield has grounding fingers extending therefrom extending forward of the front of the conductive holder for electrical connection to an interior surface of the corresponding header shield of the header assembly.

In a further embodiment, an electrical connector assembly is provided having a header assembly that includes a header housing. A plurality of header contacts are held by the header housing, and a plurality of C-shaped header shields surround corresponding header contacts on three sides. The header shields have walls that define the C-shaped header shields with interior surface and exterior surfaces. A receptacle assembly is matable to the header assembly. The receptacle assembly includes a front housing that is matable to the header housing. The receptacle assembly includes a contact module coupled to the front housing that includes a conductive holder that has a first side wall and an opposite second side wall. The conductive holder has a front coupled to the front housing. The conductive holder holds a frame assembly. The frame assembly includes a plurality of contacts and a dielectric frame supporting the contacts. The dielectric frame is received in the conductive holder. The contacts extend from the conductive holder for electrical termination to corresponding header contacts. The receptacle assembly includes a first ground shield coupled to the first side wall that is electrically connected to the conductive holder. The first ground shield has grounding beams extending therefrom extending forward of the front of the conductive holder for electrical connection to an interior surface of a corresponding header shield of the header assembly. The first ground shield has grounding fingers extending therefrom extending forward of the front of the conductive holder for electrical connection to an interior surface of the corresponding header shield of the header assembly. The receptacle assembly includes a second ground shield coupled to the second side wall that is electrically connected to the conductive holder. The second ground shield has grounding beams extending therefrom extending forward of the front of the conductive holder for electrical connection to an interior surface of a corresponding header shield of the header assembly. The second ground shield has grounding fingers extending therefrom extending forward of the front of the conductive holder for electrical connection to an interior surface of the corresponding header shield of the header assembly.

DETAILED DESCRIPTION OF THE INVENTION

Figure 1:
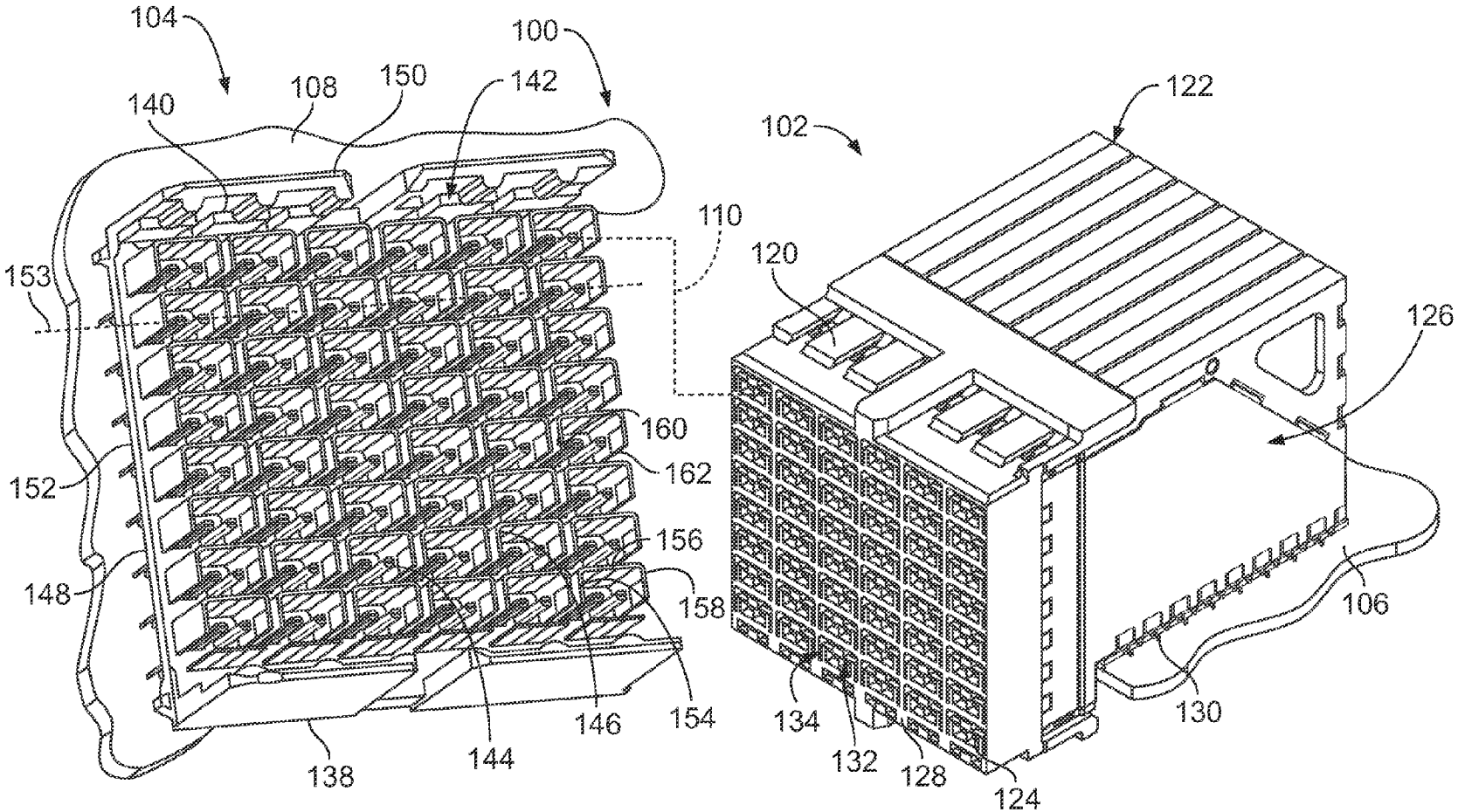
FIG. 1 is a perspective view of an electrical connector system illustrating a receptacle assembly and a header assembly formed in an exemplary embodiment.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. In an exemplary embodiment, the shield structure 126 is electrically connected to the header assembly 104 and/or the circuit board 106. For example, the shield structure 126 may be electrically connected to the header assembly 104 by extensions (e.g. beams or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding beams 302 (shown in FIG. 2) and grounding fingers 340, 370 (both shown in FIG. 2) of the contact modules 122 that mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The walls 154, 156, 158 have interior surfaces that face the header signal contacts 144 and exterior surfaces that face away from the header signal contacts 144.

The header shields 146 have edges 160, 162 at opposite ends of the header shields 146. The edges 160, 162 are downward facing. The edges 160, 162 are provided at the distal ends of the walls 154, 158, respectively. The bottom is open between the edges 160, 162. The header shield 146 associated with another pair of header signal contacts 144 provides the shielding along the open, fourth side thereof such that each of the pairs of signal contacts 144 is shielded from each adjacent pair in the same column and the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
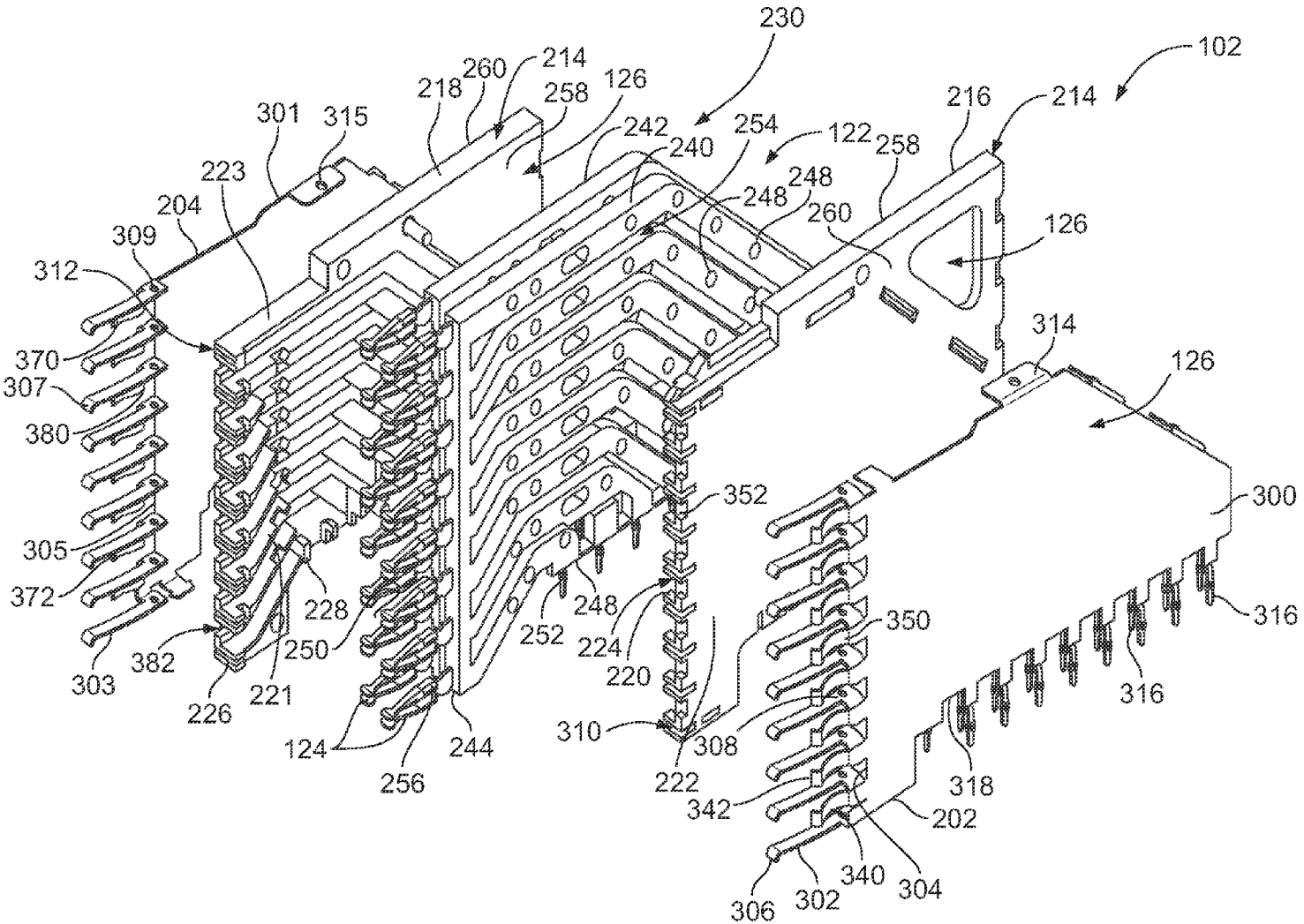
FIG. 2 is an exploded view of a contact module for the receptacle assembly shown in FIG. 1.

FIG. 2 is an exploded view of one of the contact modules 122 and part of the shield structure 126. The shield structure 126 includes a first ground shield 202 and a second ground shield 204. The first and the second ground shields 202, 204 electrically connect the contact module 122 to the header shields 146 (shown in FIG. 1). The first and the second ground shields 202, 204 provide multiple, redundant points of contact to the header shield 146. For example, the first and the second ground shields may be configured to define at least two points of contact with each C-shaped header shield. The first and the second ground shields 202, 204 provide shielding on all sides of the receptacle signal contacts 124.

The contact module 122 includes a holder 214 having a first holder member 216 and a second holder member 218 that are coupled together to form the holder 214. The holder members 216, 218 are fabricated from a conductive material. For example, the holder members 216, 218 may be die-cast from a metal material. Alternatively, the holder members 216, 218 may be stamped and formed or may be fabricated from a plastic material that has been metalized or coated with a metallic layer. By having the holder members 216, 218 fabricated from a conductive material, the holder members 216, 218 may provide electrical shielding for the receptacle assembly 102. When the holder members 216, 218 are coupled together, the holder members 216, 218 define at least a portion of the shield structure 126 of the receptacle assembly 102. The first and second ground shields 202, 204 are mechanically and electrically coupled to the holder members 216, 218, respectively, to couple the ground shields 202, 204 to the holder 214. The holder members 216, 218 include tabs 220, 221 extending inward from side walls 222, 223 thereof. The tabs 220 define channels 224 therebetween. The tabs 221 define channels similar to the channels 224. The tabs 220, 221 define at least a portion of the shield structure 126 of the receptacle assembly 102. When assembled, the holder members 216, 218 are coupled together and define a front 226 and a bottom 228 of the holder 214.

The contact module 122 includes a frame assembly 230 held by the holder 214. The frame assembly 230 includes the receptacle signal contacts 124. The frame assembly 230 includes a pair of dielectric frames 240, 242 surrounding the receptacle signal contacts 124. In an exemplary embodiment, the receptacle signal contacts 124 are initially held together as lead frames (not shown), which are overmolded with dielectric material to form the dielectric frames 240, 242. Other manufacturing processes may be utilized to form the contact modules 122, such as loading receptacle signal contacts 124 into a formed dielectric body.

The dielectric frame 240 includes a front wall 244 and a bottom wall 246. The dielectric frame 240 includes a plurality of frame members 248. The frame members 248 hold the receptacle signal contacts 124. For example, a different receptacle signal contact 124 extends along, and inside of, a corresponding frame member 248. The frame members 248 encase the receptacle signal contacts 124.

The receptacle signal contacts 124 have mating portions 250 extending from the front wall 244 and contact tails 252 extending from the bottom wall 246. Other configurations are possible in alternative embodiments. The mating portions 250 and contact tails 252 are the portions of the receptacle signal contacts 124 that extend from the dielectric frame 240. In an exemplary embodiment, the mating portions 250 extend generally perpendicular with respect to the contact tails 252. Alternatively, the mating portions 250 and the contact tails 252 may be at any angle to each other.

Inner portions or encased portions of the receptacle signal contacts 124 transition between the mating portions 250 and the contact tails 252 within the dielectric frame 240. When the contact module 122 is assembled, the mating portions 250 extend forward from the front 226 of the holder 214 and the contact tails 252 extend downward from the bottom 228 of the holder 214. In one embodiment, the dielectric frames 240, 242 may be held adjacent to each other such that the receptacle signal contacts 124 of both dielectric frames 240, 242 are aligned along a row axes and define a contact pair. In one embodiment, the receptacle signal contacts 124 may be configured to achieve a target electrical contact impedance. For example, the receptacle signal contacts 124 may include chamfered surfaces 256 that reduce the amount of material along a portion of the mating portions 250. The receptacle signal contacts 124 may be arranged such that the chamfered surfaces 256 of the receptacle signal contacts 124 within a pair of receptacle signal contacts 124 are aligned with each other and face each other. The impedance of the receptacle signal contacts 124 along the mating portions 250 may be raised by providing the chamfered surfaces 256 and removing material of the receptacle signal contacts 124. The size and/or location of the chamfered surfaces 256 may be selected to achieve a target electrical impedance, such as 100 Ohms.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

The first and the second holder member 216, 218 include side walls 222, 223 having interior surfaces 258 and exterior surfaces 260. The dielectric frames 240, 242 are received in the holder members 216, 218 on the interior surfaces 258 thereof. The dielectric frames 240, 242 are received in a space defined between the holder members 216, 218. The ground shields 202, 204 are coupled to the holder members 216, 218 on the exterior surfaces 260 thereof.

During assembly, the dielectric frame 240 and corresponding receptacle signal contacts 124 are coupled to the holder member 216. The frame members 248 are received in corresponding channels 224. The tabs 220 are received in corresponding windows 254 such that the tabs 220 are positioned between adjacent receptacle signal contacts 124. The dielectric frame 242 and corresponding receptacle signal contacts 124 are coupled to the holder member 218 in a similar manner with the tabs 221 extending through the dielectric frame 242.

The holder members 216, 218, which are part of the shield structure 126, provide electrical shielding between and around respective receptacle signal contacts 124. The holder members 216, 218 provide shielding from electromagnetic interference (EMI) and/or radio frequency interference (RFI). The holder members 216, 218 may provide shielding from other types of interference as well. The holder members 216, 218 provide shielding around the outside of the dielectric frames 240, 242 and thus around the outside of all of the receptacle signal contacts 124, such as between pairs of receptacle signal contacts 124, as well as between the receptacle signal contacts 124 using the tabs 220, 221 to control electrical characteristics, such as impedance control, cross-talk control, and the like, of the receptacle signal contacts 124.

The first ground shield 202 includes a main body 300. In the illustrated embodiment, the main body 300 is generally planar. The first ground shield 202 includes grounding beams 302 extending forward from a front 304 of the main body 300. The grounding beams 302 extend forward from the front 226 of the holder 214 such that the grounding beams 302 may be loaded into the front housing 120 (shown in FIG. 1). In an exemplary embodiment, the grounding beams 302 are bent out of plane with respect to the main body 300 such that the grounding beams 302 are oriented perpendicular with respect to the plane defined by the main body 300. In an exemplary embodiment, the first ground shield 202 is manufactured from a metal material. For example, the metal material may be phosphor-bronze, brass, copper, silver, aluminum, platinum and the like or a combination thereof.

In an exemplary embodiment, the first ground shield 202 may be stamped and formed. For example, the grounding beams 302 may be stamped and then bent during the forming process out of plane with respect to the main body 300. Optionally, the main body 300 may extend vertically while the grounding beams 302 may extend horizontally, however other orientations are possible in alternative embodiments.

Each grounding beam 302 has a mating interface 306 at a distal end thereof. The mating interface 306 is configured to engage the corresponding header shield 146. In one embodiment, the mating interface 306 may be plated for enhancing the electrical characteristics of the grounding beam 302. For example, the mating interface 306 may be plated with gold. The grounding beam 302 includes one or more projections 308 extending therefrom. The projections 308 are configured to engage the conductive holder 214 when the first ground shield 202 is coupled thereto.

In an exemplary embodiment, the holder member 216 includes slots 310 that receive the grounding beams 302 therein when the first ground shield 202 is coupled to the side wall 222 of the holder member 216. The projections 308 are received in the slots 310 and engage the holder member 216 to create an electrical connection with the holder member 216. In an exemplary embodiment, the slots 310 are vertically offset with respect to the receptacle signal contacts 124. When the grounding beams 302 are received in the slots 310, the grounding beams 302 are vertically offset with respect to the receptacle signal contacts 124. For example, the grounding beams 302 may be positioned above and/or below corresponding receptacle signal contacts 124. In an exemplary embodiment, the grounding beams 302 are generally aligned with the receptacle signal contacts 124 of the dielectric frame 240. The grounding beams 302 provide electrical shielding between one row of receptacle signal contacts 124 and another row of receptacle signal contacts 124 that is either above or below the one row of receptacle signal contacts 124.

The first ground shield 202 includes a plurality of mounting tabs 314 extending inward from the main body 300. The mounting tabs 314 are configured to be coupled to the holder member 216. The mounting tabs 314 secure the first ground shield 202 to the side wall 222. The mounting tabs 314 engage the holder member 216 to electrically connect the first ground shield 202 to the holder member 216. Any number of mounting tabs 314 may be provided. For example, in one embodiment, five mounting tabs are provided. The location of the mounting tabs 314 may be selected to secure various portions of the first ground shield 202, such as the top, the back, the front, the bottom, and the like to the holder member 216. The engagement of the projections 308 with the holder member 216 help to secure the first ground shield 202 to the holder member 216.

The first ground shield 202 includes a plurality of ground pins 316 extending from a bottom 318 of the first ground shield 202. The ground pins 316 are configured to be terminated to the circuit board 106 (shown in FIG. 1). The ground pins 316 may be compliant pins, such as eye-of-the-needle pins, that are throughhole mounted to plated vias in the circuit board 106. Other types of termination means or features may be provided in alternative embodiments to couple the first ground shield 202 to the circuit board 106.

In an exemplary embodiment, at least some of the ground pins 316 are configured to extend into the holder 214 and dielectric frame 240. The ground pins 316 are configured to be positioned in line with the contact tails 252 to provide shielding between the contact tails 252.

The first ground shield 202 includes a plurality of grounding fingers 340 extending forward from the main body 300. The grounding fingers 340 extend forward of the front 226 of the holder 214 for electrical connection to the header shield 146. The grounding fingers 340 are configured to be received in the front housing 120. The grounding fingers 340 have mating interfaces 342 at distal ends of the grounding fingers 340. In one embodiment, the mating interface 342 may be plated. For example, the mating interface 342 may be plated with gold.

The grounding fingers 340 include transition sections 350 extending inward from the main body 300. The transition sections 350 are used to transition the grounding fingers 340 out of the plane of the main body 300. The transition sections 350 transfer the mating interfaces 342 to a location that allows the grounding fingers 340 to engage an interior surface of the header shields 146. The transition sections 350 position the grounding fingers 340 directly in front of the holder member 216. The transition sections 350 of the grounding fingers 340 are received in pockets 352 at the front 226 of the conductive holder 214.

In an exemplary embodiment, when the contact module 122 is assembled, the grounding fingers 340 are offset horizontally and vertically with respect to the grounding beams 302. The grounding fingers 340 may extend along the sides of the receptacle signal contacts 124. The grounding fingers 340 may provide shielding between the receptacle signal contacts 124 and receptacle signal contacts 124 of an adjacent contact module 122 held in the receptacle assembly 102. The grounding fingers 340 may be horizontally aligned with receptacle signal contacts 124 in a corresponding row of the receptacle signal contacts 124.

The second ground shield 204 includes a main body 301. In the illustrated embodiment, the main body 301 is generally planar. The second ground shield 204 includes grounding beams 303 extending forward from a front 305 of the main body 301. The grounding beams 303 extend forward from the front 226 of the holder 214 such that the grounding beams 303 may be loaded into the front housing 120 (shown in FIG. 1). In an exemplary embodiment, the grounding beams 303 are bent out of plane with respect to the main body 301 such that the grounding beams 303 are oriented perpendicular with respect to the plane defined by the main body 301. In an exemplary embodiment, the second ground shield 204 is substantially similar to the first ground shield 202. The second ground shield 204 may be a mirrored version of the first ground shield 202.

Each grounding beam 303 has a mating interface 307 at a distal end thereof. The mating interface 307 is configured to engage the corresponding header shield 146. In one embodiment, the mating interface 307 may be plated, such as with gold. The grounding beam 303 includes one or more projections 309 extending therefrom. The projections 309 are configured to engage the conductive holder 214 when the second ground shield 204 is coupled thereto.

In an exemplary embodiment, the holder member 218 includes slots 312 that receive the grounding beams 303 therein when the second ground shield 204 is coupled to the side wall 223 of the holder member 218. The projections 309 are received in the slots 312 and engage the holder member 218 to create an electrical connection with the holder member 218. In an exemplary embodiment, the slots 312 are vertically offset with respect to the receptacle signal contacts 124. When the grounding beams 303 are received in the slots 312, the grounding beams 303 are vertically offset with respect to the receptacle signal contacts 124. For example, the grounding beams 303 may be positioned above and/or below corresponding receptacle signal contacts 124. In an exemplary embodiment, the grounding beams 303 are generally aligned with the receptacle signal contacts 124 of the dielectric frame 242. The grounding beams 303 provide electrical shielding between one row of receptacle signal contacts 124 and another row of receptacle signal contacts 124 that is either above or below the one row of receptacle signal contacts 124.

The second ground shield 204 includes a plurality of mounting tabs 315 extending inward from the main body 301. The mounting tabs 315 are configured to be coupled to the holder member 218. The mounting tabs 315 secure the second ground shield 204 to the side wall 223. The mounting tabs 315 engage the holder member 218 to electrically connect the second ground shield 204 to the holder member 218. Any number of mounting tabs 315 may be provided.

The second ground shield 204 includes a plurality of ground pins (similar to the ground pins 316 of the first ground shield 202) extending from a bottom of the second ground shield 204. In an exemplary embodiment, at least some of the ground pins are configured to extend into the holder member 218 and the dielectric frame 242. The ground pins are configured to be positioned in line with the contact tails 252 extending from the dielectric frame 242 to provide shielding between the contact tails 252. At least some of the ground pins are configured to be positioned between adjacent contact modules 122.

The second ground shield 204 includes a plurality of grounding fingers 370 extending forward from the main body 301. The grounding fingers 370 extend forward of the front 226 of the holder 214 for electrical connection to the header shield 146. The grounding fingers 370 are configured to be received in the front housing 120. The grounding fingers 370 have mating interfaces 372 at distal ends of the grounding fingers 370. In one embodiment, the mating interface 372 may be plated, such as with gold.

The grounding fingers 370 include transition sections 380 extending inward from the main body 301. The transition sections 380 are used to transition the grounding fingers 370 out of the plane of the main body 301. The transition sections 380 transfer the mating interfaces 372 to a location that allows the grounding fingers 370 to engage an interior surface of the header shields 146. The transition sections 380 position the grounding fingers 370 directly in front of the holder member 218. The transition sections 380 of the grounding fingers 370 are received in pockets 382 at the front 226 of the conductive holder 214.

In an exemplary embodiment, when the contact module 122 is assembled, the grounding fingers 370 are offset horizontally and vertically with respect to the grounding beams 303. The grounding fingers 370 may extend along the sides of the receptacle signal contacts 124. The grounding fingers 370 may provide shielding between the receptacle signal contacts 124 and receptacle signal contacts 124 of an adjacent contact module 122 held in the receptacle assembly 102. The grounding fingers 370 may be horizontally aligned with receptacle signal contacts 124 in a corresponding row of the receptacle signal contacts 124.

Figure 3:
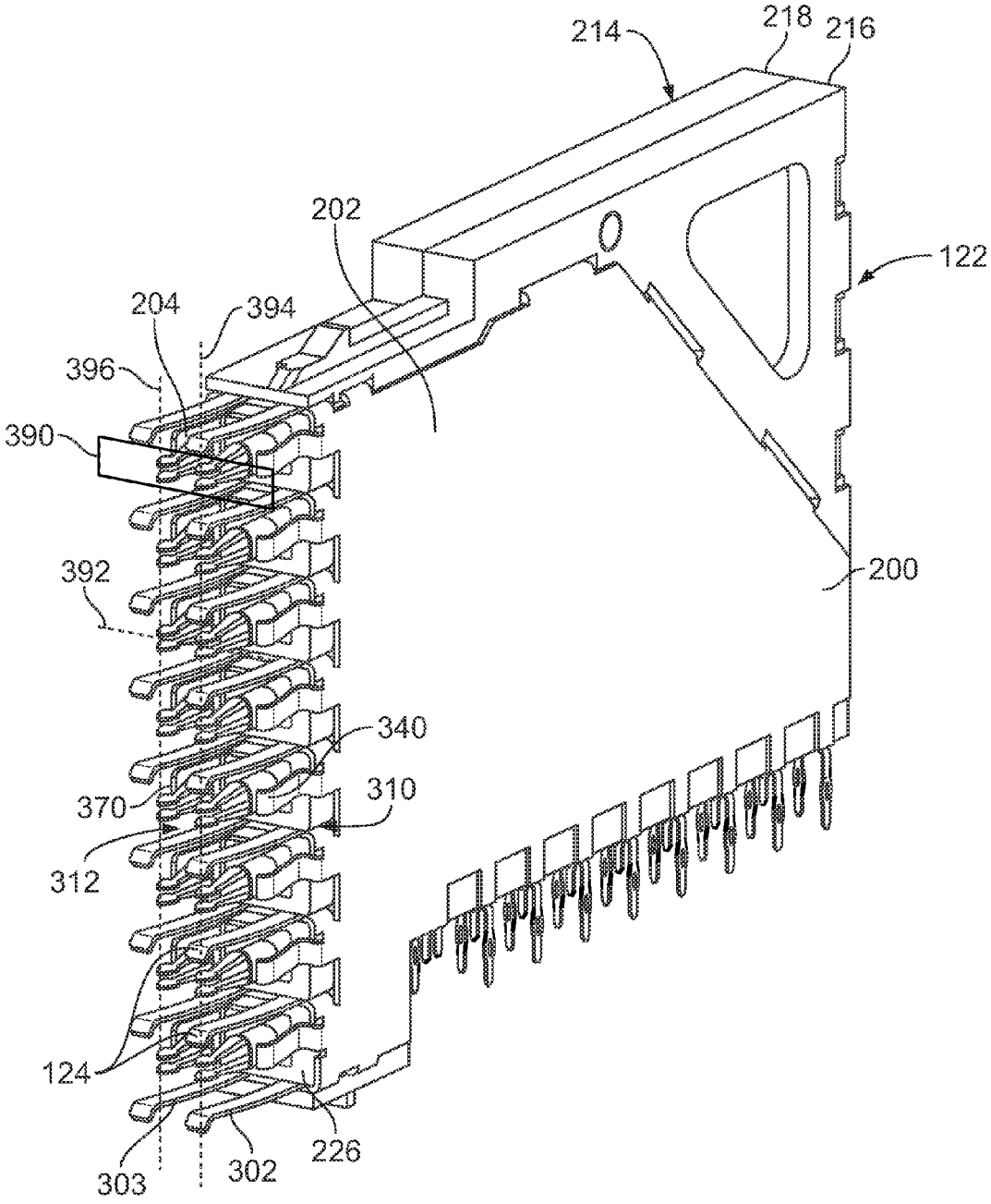
FIG. 3 is a perspective view of the contact module shown in FIG. 2 in an assembled state.

FIG. 3 is a perspective view of one of the contact modules 122 in an assembled state. During assembly, the dielectric frames 240, 242 (shown in FIG. 2) are received in the corresponding holder members 216, 218. The holder members 216, 218 are coupled together and generally surround the dielectric frames 240, 242. The dielectric frames 240, 242 are aligned adjacent one another such that the receptacle signal contacts 124 are aligned with one another and define contact pairs 390. Each contact pair 390 is configured to transmit differential signals through the contact module 122.

The receptacle signal contacts 124 within each contact pair 390 are arranged in rows that extend along row axes 392. The receptacle signal contacts 124 within the dielectric frame 240 are arranged within a column along a column axis 394. Similarly, the receptacle signal contacts 124 of the dielectric frame 242 are arranged in a column along a column axis 396.

The first and the second ground shields 202, 204 are coupled to the holder 214 to provide shielding for the receptacle signal contacts 124. When assembled, the ground shields 202, 204 are positioned on the exterior sides of the conductive holder 214. The grounding beams 302, 303 extend into the slots 310, 312 of the first and the second holder members 216, 218 respectively. The ground shields 202, 204 are also configured to electrically connect to the header shields 146 when the receptacle assembly 102 is coupled to the header assembly 104 (both shown in FIG. 1).

The grounding beams 302, 303 provide shielding for the receptacle signal contacts 124. The grounding beams 302 are aligned with the receptacle signal contacts 124 along the column axis 394. The grounding beams 303 are aligned with the receptacle signal contacts 124 along the column axis 396. In an exemplary embodiment, one set of grounding beams 302, 303 is provided below the lowermost contact pair 390, another set of grounding beams 302, 303 is provided above the uppermost contact pair 390, and sets of grounding beams 302, 303 are provided between each two vertically adjacent contact pairs 390. Each of the contact pairs 390 is thereby shielded both above and below its respective row axis 392.

The grounding fingers 340, 370 extend forward from the front 226 along the sides of corresponding contact pairs 390. The grounding fingers 340, 370 are arranged in sets that are generally aligned with the contact pairs 390 along the row axes 392. The grounding fingers 340, 370 are vertically offset with respect to the grounding beams 302, 303. During use, the grounding fingers 340, 370 are generally aligned horizontally with the contact pairs 390 while the grounding beams 302, 303 are positioned vertically between the contact pairs 390. The grounding beams 302, 303 are generally aligned with the column axes 394, 396, while the grounding fingers 340, 370 are offset horizontally outside of the column axes 394, 396.

Figure 4:
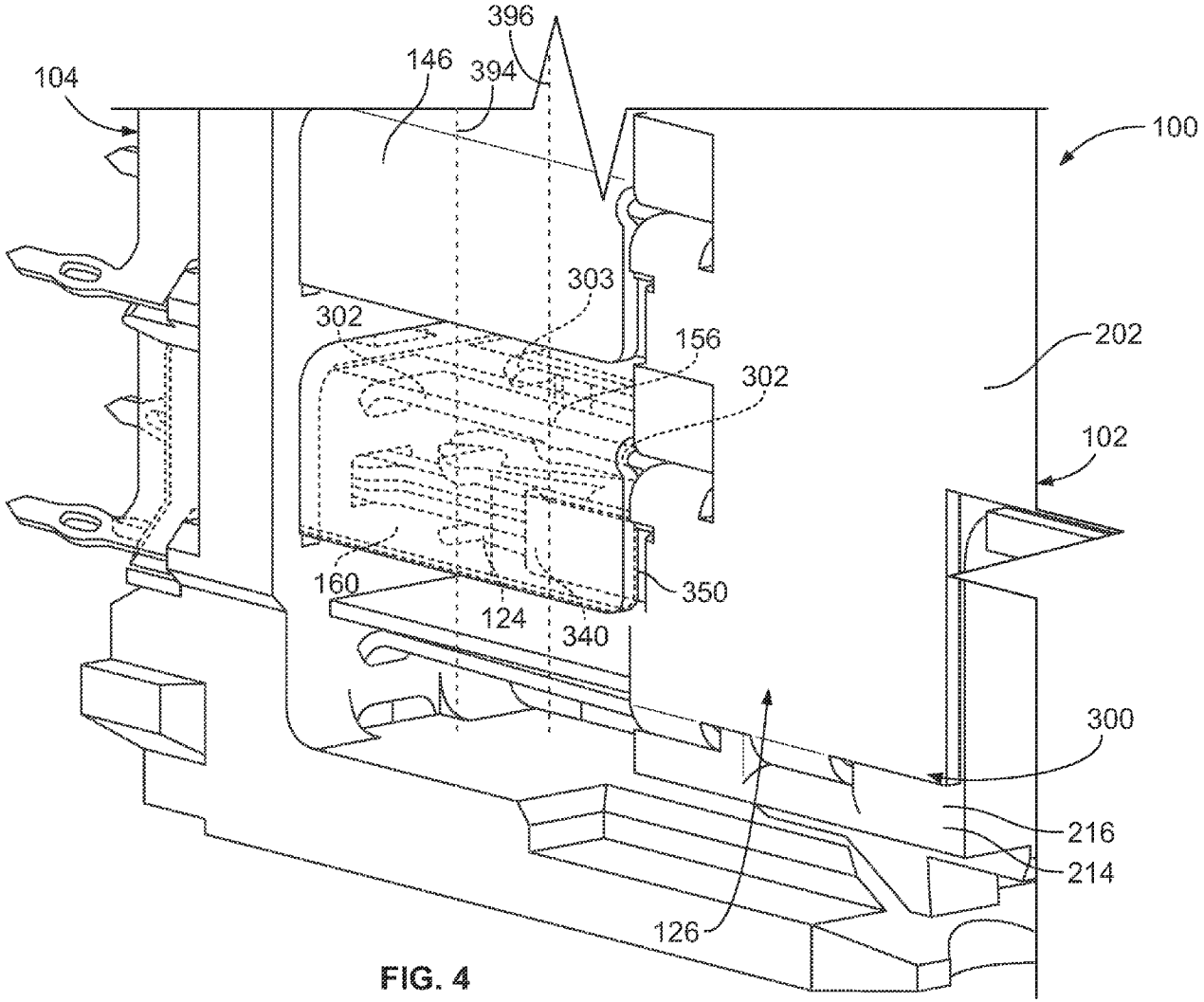
FIG. 4 is a partial sectional view of the electrical connector system showing the receptacle assembly mated to the header assembly.

FIG. 4 is a side perspective view of the electrical connector system 100 showing the receptacle assembly 102 mated to the header assembly 104. The front housing 120 (shown in FIG.

1) of the receptacle assembly 102 is removed to illustrate the grounding electrical connection between the shield structure 126 and the header shields 146. The lowermost header shield 146 is shown in phantom to show the grounding beams 302, 303 and grounding finger 340.

When mated, the header shields 146 extend into the front housing 120 to engage the ground shields 202, 204. The grounding beams 302, 303 engage an interior surface of the top wall 156 of the C-shaped header shields 146 to make electrical connection therewith. The grounding fingers 340, 370 (shown in FIG. 2) engage an interior surface of the side walls 154, 158 (shown in FIG. 1), respectively, of the C-shaped header shields 146 to make electrical connection therewith. By engaging the interior surface of the side walls 154, 158, the grounding fingers 340, 370 are forced inward, which pull the ground shields 202, 204 inward. Such action tends to force the ground shields 202, 204 against, and into electrical contact with, the conductive holder 214. Such action tends to compress the holder members 216, 218 together. Optionally, the ground shields 202, 204 may include spring beams or tabs that engage a ground shield of an adjacent contact module 122 to electrically common the ground shield 202 of one contact module 122 with the ground shield 204 of the adjacent contact module 122.

In an exemplary embodiment, the grounding beams 302, 303 and the grounding fingers 340, 370 are deflectable and are configured to be spring biased against the header shields 146 to ensure electrical connection with the header shields 146. In an exemplary embodiment, the header shields 146 and the shield structure 126 provide 360° shielding for the receptacle signal contacts 124. For example, the side walls 154, 158 and the grounding fingers 340, 370 both extend along the side of the receptacle signal contacts 124 to provide shielding along the sides of the receptacle signal contacts 124 between the columns of the receptacle signal contacts 124, such as between receptacle signal contacts 124 held within different contact modules 122. The grounding beams 302, 303 and the top walls 156 both extend along the top of receptacle signal contacts 124. The top walls 156 provide shielding between receptacle signal contacts 124 in different rows.

The shield structure 126 has multiple, redundant points of contact with each of the C-shaped header shields 146. For example, four points of contact are defined by the grounding fingers 340, 370 (shown in FIG. 3) and the grounding beam 302, 303. The electrical performance of the electrical connector system 100 is enhanced with multiple ground contact points to the C-shaped header shield 146, as compared to systems that have a single ground contact point.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a front housing configured for mating with a header assembly;

a contact module coupled to the front housing, the contact module including a conductive holder having a first side wall and an opposite second side wall, the conductive holder having a front coupled to the front housing, the conductive holder holding a frame assembly, the frame assembly comprising a plurality of contacts and a dielectric frame supporting the contacts, the dielectric frame being received in the conductive holder, the contacts extending from the conductive holder for electrical termination; and a ground shield coupled to the first side wall, the ground shield being electrically connected to the conductive holder, the ground shield having grounding beams extending therefrom, the grounding beams extending forward of the front of the conductive holder for electrical connection to an interior surface of a corresponding header shield of the header assembly, the ground shield having grounding fingers extending therefrom, the grounding fingers extending forward of the front of the conductive holder for electrical connection to an interior surface of the corresponding header shield of the header assembly.

2. The receptacle assembly of claim 1, wherein the grounding beams and the grounding fingers are configured to define at least two points of contact with each header shield.

3. The receptacle assembly of claim 1, wherein the grounding beams and grounding fingers are plated at mating interfaces thereof.

4. The receptacle assembly of claim 1, wherein the grounding beams extend along tops of corresponding contacts and the grounding fingers extend along sides of corresponding contacts.

5. The receptacle assembly of claim 1, wherein the ground shield includes mounting tabs extending inward therefrom, the mounting tabs engaging the conductive holder to create an electrical connection with the conductive holder.

6. The receptacle assembly of claim 1, wherein the first side wall has an interior surface and an exterior surface, the dielectric frame being received in the conductive holder and extending along the interior surface, the ground shield being coupled to the conductive holder on the exterior surface, the grounding fingers being received in pockets at the front of the conductive holder, the grounding fingers electrically engaging the exterior surface of the first side wall.

7. The receptacle assembly of claim 1, wherein the conductive holder includes a first holder member and a second holder member coupled to the first holder member, the frame assembly including a second dielectric frame holding a plurality of contacts, the second dielectric frame being received in the second holder member, the other dielectric frame being received in the first holder member and held adjacent the second dielectric frame, a second ground shield being coupled to the second holder member.

8. The receptacle assembly of claim 1, wherein the ground shield comprises ground pins extending from a bottom of the ground shield, the ground pins being configured to be terminated to a circuit board, at least some of the ground pins being positioned approximately in line between contact tails of the contacts that are configured to be terminated to the circuit board.

9. The receptacle assembly of claim 1, wherein the receptacle assembly comprises a plurality of the contact modules, the plurality of contact modules held together by the front housing, the ground shields of the contact modules being positioned between conductive holders of adjacent contact modules.

10. A receptacle assembly comprising:

a front housing configured for mating with a header assembly;

a contact module coupled to the front housing; the contact module including a conductive holder having a first side wall and an opposite second side wall, the conductive holder having a front coupled to the front housing, the conductive holder holding a frame assembly, the frame assembly comprising a plurality of contacts arranged in pairs, the frame assembly having at least one dielectric frame supporting the contacts, the at least one dielectric frame being received in the conductive holder, the contacts extending from the conductive holder for electrical termination;

a first ground shield coupled to the first side wall, the first ground shield being electrically connected to the conductive holder, the first ground shield having grounding beams extending therefrom extending forward of the front of the conductive holder for electrical connection to an interior surface of a corresponding header shield of the header assembly, the first ground shield having grounding fingers extending therefrom extending forward of the front of the conductive holder for electrical connection to an interior surface of the corresponding header shield of the header assembly; and a second ground shield coupled to the second side wall, the second ground shield being electrically connected to the conductive holder, the second ground shield having grounding beams extending therefrom extending forward of the front of the conductive holder for electrical connection to an interior surface of a corresponding header shield of the header assembly, the second ground shield having grounding fingers extending therefrom extending forward of the front of the conductive holder for electrical connection to an interior surface of the corresponding header shield of the header assembly.

11. The receptacle assembly of claim 10, wherein the grounding beams and the grounding fingers are configured to define at least four points of contact with each header shield.

12. The receptacle assembly of claim 10, wherein the grounding beams of the first ground shield extend above tops of corresponding pairs of contacts and the grounding fingers of the first ground shield extend along sides of corresponding pairs of contacts, and wherein the grounding beams of the second ground shield extend above tops of corresponding pairs of contacts and the grounding fingers of the second ground shield extend along sides of corresponding pairs of contacts.

13. The receptacle assembly of claim 10, wherein the grounding beams and grounding fingers of the first and second ground shields are arranged in sets that surround corresponding pairs of contacts on three sides for electrical contact to the header shield on three sides of the pair of contacts.

14. The receptacle assembly of claim 10, wherein the pairs of contacts are arranged along row axes, the grounding fingers of the first and second ground shields being aligned with corresponding pairs of contacts along the row axes, the grounding beams of the first and second ground shields being positioned between row axes, in line with the contacts along column axes.

15. The receptacle assembly of claim 10, wherein the first ground shield includes mounting tabs extending inward therefrom, the mounting tabs of the first ground shield engage the first side wall of the conductive holder to create an electrical connection with the conductive holder, and wherein the second ground shield includes mounting tabs extending inward therefrom, the mounting tabs of the second ground shield engage the second side wall of the conductive holder to create an electrical connection with the conductive holder.

16. The receptacle assembly of claim 10, wherein the conductive holder includes a first holder member and a second holder member each having an interior surface and an exterior surface, the at least one dielectric frame being received in a space defined between the first and second holder members and engaging the interior surfaces of the first and second holder members, the first and second ground shields being coupled to the exterior surfaces of the first and second holder members, respectively, the grounding fingers being received in pockets at the front of the conductive holder, the grounding fingers electrically engaging the conductive holder.

17. The receptacle assembly of claim 10, wherein the at least one dielectric frame includes first and second dielectric frames, the conductive holder includes a first holder member and a second holder member coupled to the first holder member, the first dielectric frame being received in the first holder member, the second dielectric frame being received in the second holder member and held adjacent the first dielectric frame, the first ground shield being coupled to the first holder member, the second ground shield being coupled to the second holder member.

18. The receptacle assembly of claim 10, wherein the first and second ground shields each include ground pins extending from bottoms thereof, the ground pins being configured to be terminated to a circuit board, at least some of the ground pins being positioned in line between contact tails of corresponding contacts that are configured to be terminated to the circuit board.

19. The receptacle assembly of claim 10, wherein the receptacle assembly comprises a plurality of the contact modules, the plurality of contact modules held together by the front housing, the first and second ground shields of the contact modules being positioned between conductive holders of adjacent contact modules.

20. An electrical connector assembly comprising:

a header assembly comprising a header housing, a plurality of header contacts held by the header housing, and a plurality of C-shaped header shields surrounding corresponding header contacts on three sides, the header shields having walls defining the C-shaped header shields, the walls of the C-shaped header shields have interior surfaces and exterior surfaces; and a receptacle assembly matable to the header assembly, the receptacle assembly comprising:

a front housing matable to the header housing;

a contact module coupled to the front housing; the contact module including a conductive holder having a first side wall and an opposite second side wall, the conductive holder having a front coupled to the front housing, the conductive holder holding a frame assembly, the frame assembly comprising a plurality of contacts arranged in pairs, the frame assembly having at least one dielectric frame supporting the contacts, the at least one dielectric frame being received in the conductive holder, the contacts extending from the conductive holder for electrical termination;

a first ground shield coupled to the first side wall, the first ground shield being electrically connected to the conductive holder, the first ground shield having grounding beams extending therefrom extending forward of the front of the conductive holder for electrical connection to an interior surface of a corresponding header shield of the header assembly, the first ground shield having grounding fingers extending therefrom extending forward of the front of the conductive holder for electrical connection to an interior surface of the corresponding header shield of the header assembly; and a second ground shield coupled to the second side wall, the second ground shield being electrically connected to the conductive holder, the second ground shield having grounding beams extending therefrom extending forward of the front of the conductive holder for electrical connection to an interior surface of a corresponding header shield of the header assembly, the second ground shield having grounding fingers extending therefrom extending forward of the front of the conductive holder for electrical connection to an interior surface of the corresponding header shield of the header assembly.

* * * * *